US008448955B2

(12) United States Patent
Kinnaman

(10) Patent No.: US 8,448,955 B2
(45) Date of Patent: May 28, 2013

(54) THREE-WHEELED SKATEBOARD

(76) Inventor: Brent H. Kinnaman, Carlsbad, CA (US)

( * ) Notice: Subject to any disclaimer, the term of this patent is extended or adjusted under 35 U.S.C. 154(b) by 0 days.

(21) Appl. No.: 13/272,019

(22) Filed: Oct. 12, 2011

(65) Prior Publication Data

US 2012/0086181 A1 Apr. 12, 2012

Related U.S. Application Data

(60) Provisional application No. 61/392,398, filed on Oct. 12, 2010.

(51) Int. Cl.

| | |
|---|---|
| ***A63C 17/02*** | (2006.01) |
| ***A63C 17/04*** | (2006.01) |
| ***A63C 17/06*** | (2006.01) |
| *A63C 17/22* | (2006.01) |

(52) U.S. Cl.
CPC *A63C 17/06* (2013.01); *A63C 17/22* (2013.01)
USPC ..... 280/11.27; 280/11.223

(58) Field of Classification Search
CPC ..... A63C 17/06; A63C 17/22
USPC ..... 280/87.041–87.043, 11.223, 11.27, 280/11.26, 87.03, 809, 47.12, 47.15, 87.029
See application file for complete search history.

(56) References Cited

U.S. PATENT DOCUMENTS

| | | | | |
|---|---|---|---|---|
| 7,314,223 | B2 * | 1/2008 | Lin | 280/87.042 |
| 2002/0195788 | A1 * | 12/2002 | Tierney et al. | 280/87.042 |
| 2004/0140634 | A1 * | 7/2004 | Chen et al. | 280/11.212 |
| 2005/0139406 | A1 * | 6/2005 | McLeese | 180/180 |

* cited by examiner

*Primary Examiner* — John Walters
*Assistant Examiner* — James Triggs
(74) *Attorney, Agent, or Firm* — Richard D. Clarke

(57) ABSTRACT

Three wheeled skateboards having direct connection between the front and back skate wheels where there is improved maneuverability and turning capability is provided. A steering plate is added to the axle of a conventional front skateboard truck and is made specifically for this application. Both ends of the single cable are fixably attached to the steering plate and are connected to the single rear wheel truck to supply the direct mechanical linkage. The single wheel truck at the rear has the wheel mounted in such a way as to allow it to be turned by the mechanical linkage that carries turn motion from the two wheel truck at the front of the skateboard. The single wheel mounted to the rear of the centerline of the truck rather than in front of or on the centerline of the truck increases the quickness of the action of the skateboard.

18 Claims, 3 Drawing Sheets

THREE-WHEELED SKATEBOARD

FIELD OF THE INVENTION

This invention relates in general to certain new and useful improvements in skateboards having direct connection between the front to back skate wheels, and more particularly to a three-wheeled skateboard in which there is improved maneuverability and turning capability.

BACKGROUND OF THE INVENTION

It is generally accepted that the recreational sport of skateboarding developed as an offshoot of surfing sometime in the late 1960s. As such, the skateboard was, and still is, intended to provide a similar athletic experience to surfing. In recent years, the sport of skateboarding has become popular throughout the industrialized world. This acceptance of the sport is due in large part to technological developments which have improved the ride and handling of skateboards so that they better approximate the smooth ride of a surfboard on water.

At one time, roller skates were commonly provided with trucks similar to the trucks found nowadays on most skateboards. Typically, roller skates of this design had two sets of two wheels mounted on pivoting trucks, with the four wheels being disposed essentially at the corners of a rectangle. This old design has given way in popularity recently to an in-line roller blade configuration, with a plurality of wheels arranged along the median longitudinal axis of the roller skate. An in-line arrangement of wheels provides for more speed and maneuverability than the rectangular arrangement of wheels on pivoting trucks. However, the in-line configuration naturally sacrifices a degree of stability to achieve improved maneuverability.

In its most common current form, a skateboard typically includes a board 6 to 12 inches wide and 18 to 72 inches long. Boards are typically made of wood. Two sets of two polyurethane wheels are typically mounted on the bottom side of the board, one set of wheels being attached towards the front end of the board, the other set of wheels being attached towards the rear end of the board. The rear and front two-wheeled trucks on conventional skateboards are independent and not mechanically connected in any way which results in a skateboard that is relatively difficult to control in turns. Moreover, the turning radius is relatively large because the skateboard trucks are independently acting to accomplish a turn in direction of the tilt of the skateboard.

There is a need for a skateboard design that combines the speed and maneuverability of an in-line wheel arrangement with the handling and stability of laterally disposed wheels. It would be advantageous if such a design with a single wheel in the rear and two wheels in the front would exhibit handling characteristics that better mirrored the handling of a surfboard on water or a snowboard.

Numerous innovations for skateboards have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Three-wheeled Skateboard and the prior art.

U.S. Pat. No. 4,795,181 of Robert B. Armstrong describes a skateboard that is comprised of a single oversized centrally-located wheel in addition to conventional pairs of front and rear wheels. The wheels are arranged so that the board will ride on no more than three wheels at a time, with either the front or rear pair being elevated above the supporting ground surface, depending upon the rider's longitudinal weight distribution on the skateboard relative to the center wheel. An optional foot-operated friction brake can engage with the center wheel.

This patent describes a skateboard that is comprised of a single oversized centrally-located wheel in addition to conventional pairs of front and rear wheels but does not use the single wheel in the rear in combination with two wheels in the front along with the mechanical connection between them.

U.S. Pat. No. 5,322,312 of Milton A. Cammack describes a user-propelled vehicle that has a wheelchair embodiment and a three-wheeled skateboard embodiment. In the wheelchair embodiment, a foldable frame has a seat for supporting the user and a propulsor movably attached to the frame for allowing the user to pump the propulsor. The propulsor is engaged with both rear wheels of the wheelchair through independent ratchet-clutch mechanisms for permitting torque to be transferred to one or both wheels when the propulsor is pumped to propel and steer the wheelchair. In the three-wheeled skateboard embodiment, a frame has two wheels mounted in tandem near the front of the frame and a third wheel mounted on the centerline of the frame behind the front wheels. Two pedals are hingedly mounted side-by-side on the frame and are ratchetably engaged with the rear wheel. Each pedal is movable between a thrust position, wherein the front portion of the pedal is raised from the frame, and a rest position, wherein the pedal is flush with the frame. Each pedal is spring-returned to its thrust position. The user can alternately or simultaneously depress the pedals to impart torque to the rear wheel and thereby propel the skateboard.

This patent describes a user-propelled vehicle that has a wheelchair embodiment and a three-wheeled skateboard embodiment. In the wheelchair embodiment, a foldable frame has a seat for supporting the user and a propulsor movably attached to the frame for allowing the user to pump the propulsor. Although this patent describes a three wheeled skateboard it deals mainly with a means of propulsion and does not provide a mechanical connection between the front wheels and the back wheel to create a tighter turning radius.

U.S. Pat. No. 6,428,022 of Yoshi Namiki describes an inline skateboard capable of being propelled by leg motion of a rider and which includes a platform supporting the rider along with a front wheel truck and a rear wheel truck. Each of these wheel trucks carries a single wheel. Moreover, the wheels are capable of slight turning movement transversely with respect to the platform and provide a high degree of maneuverability and turning capability. The wheels on each of the trucks are offset with respect to a pivot axis for each of the trucks. In, addition, the axis of rotation of the front wheel is displaced rearwardly of the front pivot axis and the axis of rotation of the rear wheel is displaced forwardly of the rear pivot axis. Further, the angle of displacement of these pivot axes with respect to the axis of rotation is the same. Each of the wheels have relatively flat riding surfaces and relatively flat side walls with arcuate connecting sections extending between the flat side walls and the relatively flat riding surfaces, such that only the outer edges of the wheels are arcuate in shape. This construction provides for highly effective maneuverability and steering capability.

This patent describes an inline skateboard capable of being propelled by leg motion of a rider. The inline skateboards generally have single wheels in the front and rear and are very difficult to operate. This patent does not make use of any mechanical connection between the front wheels and the back wheel.

U.S. Pat. No. 7,083,178 of Steven Dickinson Potter describes a skateboard for use on pavement, ice or snow using a single narrow-footprint wheel, ice-blade or ski-runner attached to each foot, thus requiring the rider to dynamically balance the board. The skateboard is capable of self-propulsion at considerable speed on the flat or uphill by using an undulating motion. It can also lean up to 30 degrees and has a steering circle of only two feet. The board's construction comprises a front footboard, a rear footboard, and a strut which connects the two footboards and resists bending and extension. Each footboard includes a footpad, an attachment (i.e. a wheel, blade or ski), and a pivot joint connecting to the strut. The axis of this joint is aligned perpendicular to the footpad which allows the rider to steer each footboard independently by torsionally rotating the lower leg.

This patent describes a skateboard for use on pavement, ice or snow using a single narrow-footprint wheel, ice-blade or ski-runner attached to each foot. This skateboard again does not make use of any mechanical connection between the front wheels and the back wheel.

U.S. Pat. No. 7,367,572 of Xiancan Jiang describes a skateboard in accordance that includes a footplate having a lower surface, a front wheel and a rear wheel arranged in a front end and a rear end of the lower surface respectively, wherein the wheels are universal, and the footplate includes a front plate and a rear plate. The front plate and the rear plate are connected via a rotatable torsional mechanism, and a restriction element is defined between each plate and the torsional mechanism for restricting the rotation range of the torsional mechanism.

This patent describes a skateboard where rotatable torsional mechanism and a restriction element is defined between each plate and the torsional mechanism for restricting the rotation range of the torsional mechanism. These skateboards do not make use of any mechanical connection between the front wheels and the back wheel to give a quicker action and reduced turning radius.

None of these previous efforts, however, provides the benefits attendant with the Three-wheeled Skateboard. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the Three-wheeled Skateboard in detail it is to be understood that the design is not limited in its application to the details of construction and to the arrangement, of the components set forth in the following description or illustrated in the drawings. The Three-wheeled Skateboard is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the Three-wheeled Skateboard is to provide a skateboard that has a smooth variable maneuvering ride like a surfboard.

Another advantage of the Three-wheeled Skateboard is to provide a skateboard that has a very tight turning radius.

Another advantage of the Three-wheeled Skateboard is to provide a skateboard that can switch back and forth in an action similar to a surfboard or snowboard.

Another advantage of the Three-wheeled Skateboard is to provide a skateboard with a single wheel in back that produces less drag than two wheels in the back when maneuvering.

Another advantage of the Three-wheeled Skateboard is to provide a skateboard with a smoother ride than a conventional skateboard.

Another advantage of the Three-wheeled Skateboard is to provide a skateboard with a mechanical linkage between the two front wheels and the rear wheel.

Yet another advantage of the Three-wheeled Skateboard is to provide a skateboard with easily replaceable parts.

And still another advantage is the Three-wheeled Skateboard is much quicker in all the actions.

The preferred embodiment of the Three-wheeled Skateboard will be comprised of any hard material or layers of materials (wood, metal, plastic or resin composite) laminated together of sufficient strength to support wheel assemblies of the skate board. The wheel assemblies more commonly called skateboard trucks are located on either end of the board member or skateboard deck. It must be made clear at this time skateboards are generally ridden in either direction with no front or back required and the skateboard of this application can be ridden in the same manner but for clarity the terminology of front and back has been used to define general locations.

The front two wheel skateboard truck is based on a conventional skateboard truck with the addition of a steering plate. The steering plate may be welded to the axle of a conventional skate board truck or may be cast as part of the axel of a truck made specifically for this application. Both ends of the single cable are fixably attached to the steering plate by the means of conventional bicycle cable locking nut and bolt. The cable section going to the right in the illustration wraps around a cable spacer and is held in place by the means of a cable retainer. The cable section going to the left in the illustration performs in a similar action on the back side of the steering plate around a cable spacer and cable retainer and held in place by the means of a steering plate bolt. Below the conventional skateboard truck is an adapter plate with two up-right members holding the cable retainers that are in turn connected to the rigid cable guides. The rigid cable guides are affixed and enter into the skate board front section.

The single wheel truck at the rear has a single wheel mounted in such a way as to allow it to be turned by a mechanical linkage that carries turn motion from the two wheel truck at the front end of the skateboard deck to the rear. The single wheel is mounted to the rear of the centerline of the truck instead of at or in front of the centerline of the truck increasing the quickness of the action of the wheel's movement. A cushioning section is mounted below a rear wheel base plate and is rigidly attached to the board rear section. The rear wheel base plate has two up-right members that hold the two cable tightening units. After exiting the cable tightening units the cable goes around two cable guide screws and is locked in place by another means of conventional bicycle cable locking nut and bolt to the pivoting rear wheel mounting welded assembly.

The rear wheel base plate has a guide slot where a guide member is attached to the front of the rear wheel mounting welded assembly limiting the travel of the rotation. The rear wheel mounting welded assembly is composed of a flat plate with two outboard sections where the cable guide screws are mounted and a rear section where the conventional bicycle cable locking nut and bolt lock the cable to the pivoting rear wheel mounting welded assembly to facilitate the rotational action. Two wheel mounting members are canted rearward with the rear wheel held by the means of a wheel bolt and nut. A central pivot bolt goes through the rear wheel mounting assembly and through a thrust bearing, then into the rear wheel base plate.

The axle of the two wheel carriage rotates as the rider shifts the weight to the left or right side of the deck. The two wheel carriage axle turns to the side where the weight is applied, e.g., the rider applies pressure to the right side of the deck and the two wheel carriage axle rotates to turn the deck in that direction. As the two wheel carriage axle rotates it causes the single wheel at the other end of the deck, via the mechanical linkage, to turn in such a way as to greatly decrease the turning radius.

This invention is used in the same way and similar locations as conventional skateboards, however the rider will have to relearn steering techniques for this invention. Snow boarders will find the steering behavior of this skateboard to be very similar to that of snowboards. Turning the single wheel via a mechanical linkage to the two wheel carriage turning mechanism at the other end of the skateboard is unique.

The foregoing has outlined rather broadly the more pertinent and important features of the present Three-wheeled Skateboard in order that the detailed description of the application that follows may be better understood so that the present contribution to the art may be more fully appreciated. Additional features of the design will be described hereinafter which form the subject of the claims of this disclosure. It should be appreciated by those skilled in the art that the conception and the disclosed specific embodiment may be readily utilized as a basis for modifying or designing other structures and methods for carrying out the same purposes of the present design. It should also be realized by those skilled in the art that such equivalent constructions and methods do not depart from the spirit and scope of this application as set forth in the appended claims.

BRIEF DESCRIPTION OF THE DRAWINGS

The accompanying drawings, which are incorporated in and form a part of this specification, illustrate embodiments of the Three-wheeled Skateboard and together with the description, serve to explain the principles of this application.

For a fuller understanding of the nature and advantages of the Three-wheeled Skateboard, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENT

Figure 1:
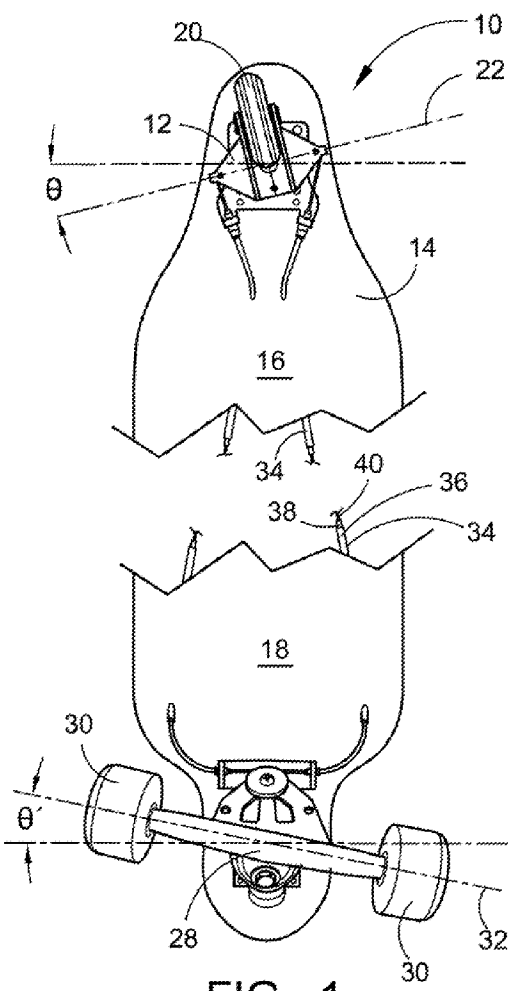
FIG. 1 depicts the bottom view of the Three-wheeled Skateboard with the rear wheel truck turning in a counter clockwise direction with the front truck turning in a clockwise direction.

Referring now to the drawings, wherein similar parts of the Three-wheeled Skateboard 10 are identified by like reference numerals, there is seen in FIG. 1 the bottom view of the Three-wheeled Skateboard 10 with the rear single wheel truck 12 turning in a counter clockwise direction depicted as angle θ with the rear truck turning in a clockwise direction depicted as angle θ'. The skateboard 14 typically includes a board 6 to 12 inches wide and 18 to 72 inches long has been depicted in two sections, the board rear section 16 and the board front section 18. The rear single wheel truck 12 is shown with the rear wheel 20 offset in rear of the truck center line 22. With the single wheel 20 mounted in rear of the front centerline 22 of the rear single wheel truck 12 instead of on the centerline or in front of the centerline 22 of the rear single wheel truck 12 increases the quickness of the action of the rear wheel 20 movement.

The front dual wheel truck 28 has two wheels 30 shown front centerline 32 turning in a clockwise direction depicted as angle θ' being the opposite of the rear single wheel truck 12 turning in a counter clockwise direction depicted as angle θ thus turning the Three-wheeled Skateboard 10 in a tight radius. The mechanical connection between the rear single wheel truck 12 and the front dual wheel truck 28 is made by the means of the interconnecting cable member 34 consisting of the cable sheath 36, the sheath Teflon liner 38 and the steering cable 40.

Figure 2:
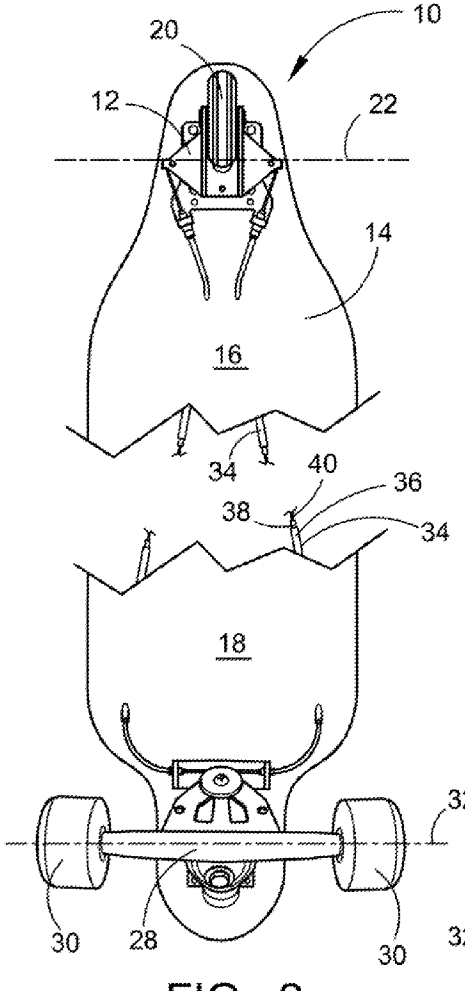
FIG. 2 depicts the bottom view of the Three-wheeled Skateboard with the rear single wheel truck and the front dual wheel truck going in the same direction.

FIG. 2 depicts the bottom view of the Three-wheeled Skateboard 10 with the rear single wheel truck 12 and the front dual wheel truck 28 going in the same direction with centerlines 22 and 32 parallel.

Figure 3:
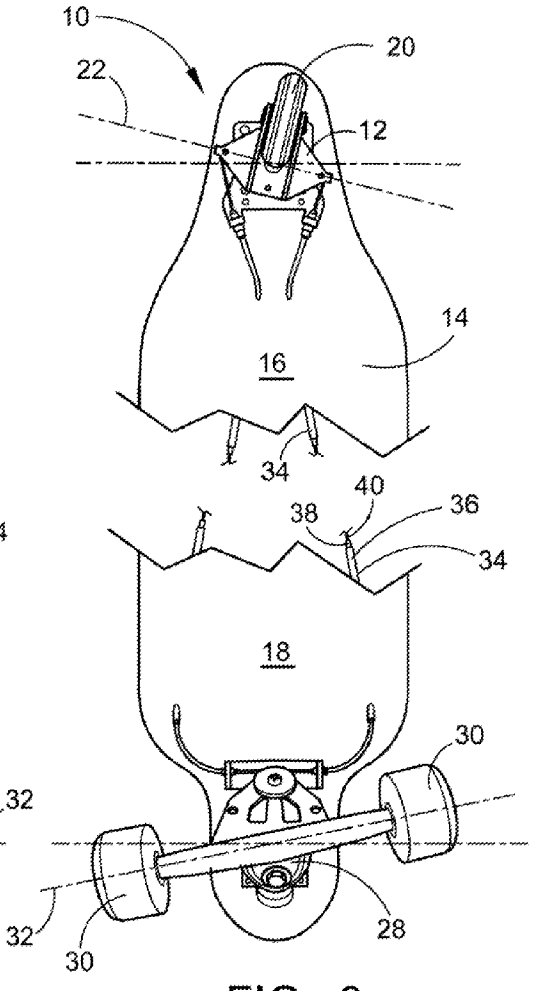
FIG. 3 depicts the bottom view of the Three-wheeled Skateboard with the rear single wheel truck turning in a clockwise direction with the front dual wheel truck turning in a counter clockwise direction.

FIG. 3 depicts the bottom view of the Three-wheeled Skateboard 10 with the rear wheel single wheel truck 12 turning in a clockwise direction with the front dual wheel truck 28 turning in a counter clockwise direction.

Figure 4:
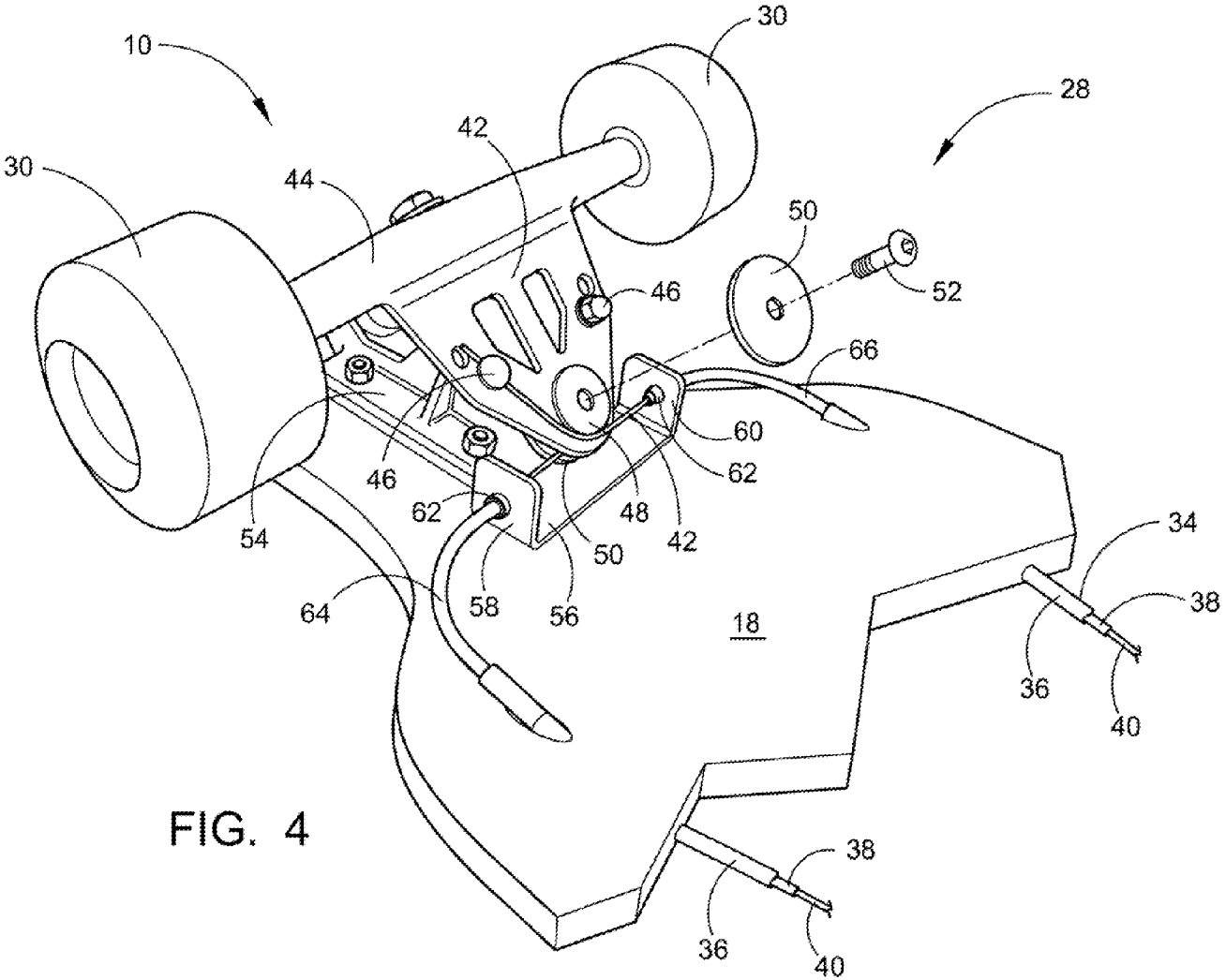
FIG. 4 depicts an exploded perspective view of the front dual wheel truck of the Three-wheeled Skateboard.

FIG. 4 depicts an exploded perspective view of the front wheel truck 28 mounted to the board front section 18 of the Three-wheeled Skateboard 10. A steering plate 42 is attached to the axle housing 44 to move back and forth as the front wheel truck 28 rotates within its housing. Both ends of the single steering cable 40 are fixably attached to the steering plate 42 by the means of conventional bicycle cable locking and bolts 46. The steering cable 40 section going to the right in the illustration wraps around a cable spacer 48 and is held in place by the means of a cable retainer 50. The steering cable 40 section going to the left in the illustration performs in a similar action on the back side Of the steering plate 42 around a cable spacer 48 and cable retainer 50 and held in place by the means of a steering plate bolt 52. Below the conventional skateboard truck 54 is an adapter plate 56 with two up-right members 58 and 60 holding the cable retainers 62 that are in turn connected to the rigid cable guides 64 and 66. The rigid cable guides 64 and 66 are affixed to the cable sheath 36 and enter into the skate board rear section 16.

Figure 5:
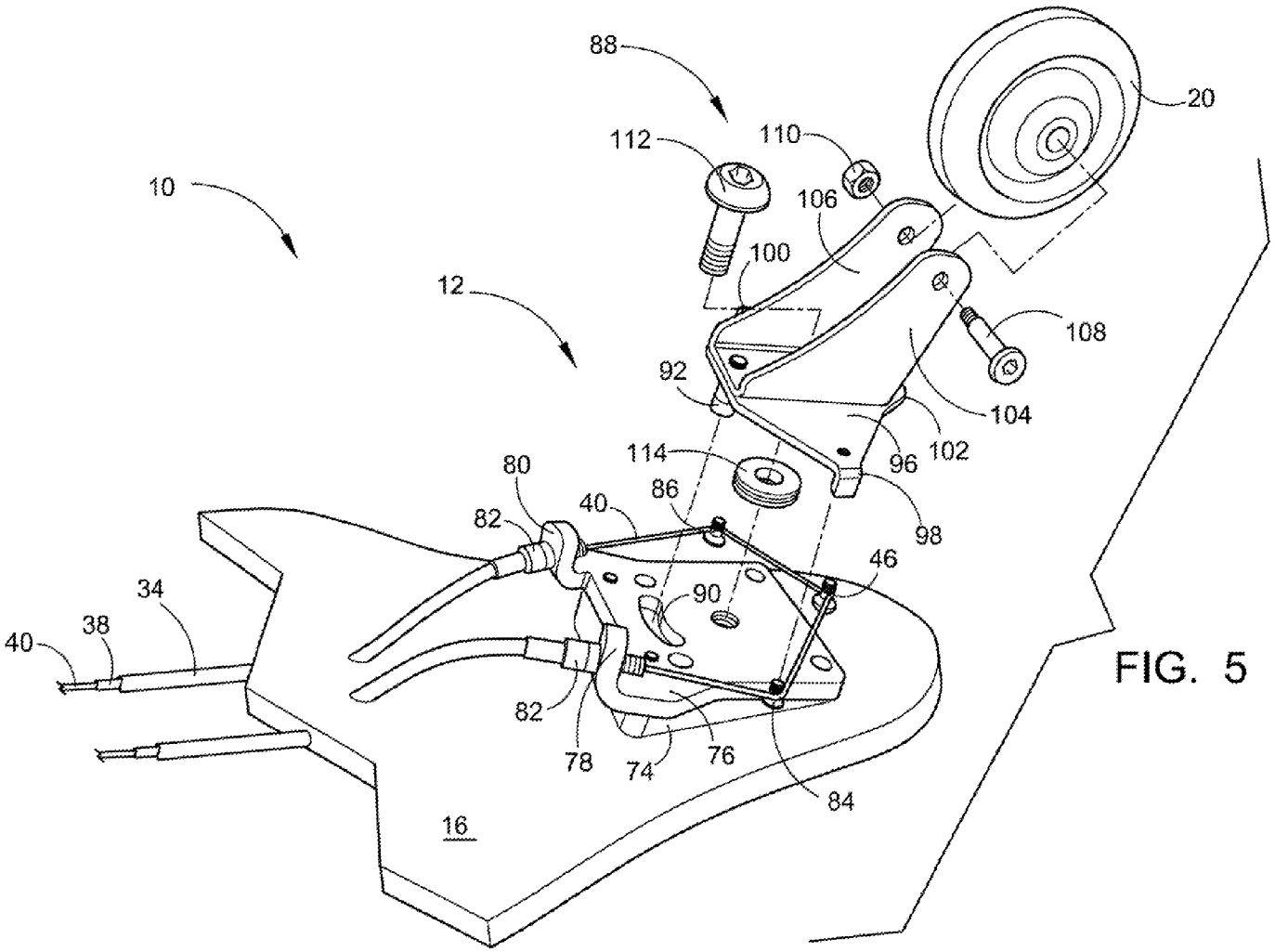
FIG. 5 depicts an exploded perspective view of the rear single wheel truck of the Three-wheeled Skateboard.

FIG. 5 depicts an exploded perspective view of the unique rear wheel truck 12 of the Three-wheeled Skateboard 10 where a cushioning section 74 is mounted below the rear wheel base plate 76 and is rigidly attached to the board rear section 16. The rear wheel base plate 76 has two up-right members 78 and 80 that hold the two cable tightening units 82 used on bicycle brake systems. After exiting the cable tightening units 82 the steering cable 40 goes around two cable guide screws 84 and 86 and is then locked in place by another the means of conventional bicycle cable locking bolt 46 to the pivoting rear wheel mounting welded assembly 88. The rear wheel base plate 76 has a guide slot 90 where a guide member 92 attached to the under portion of the front of the rear wheel mounting welded assembly 88, limits the rotational travel. The rear wheel mounting welded assembly 88 is composed of a flat plate 96 with two outboard sections 98 and 100 where the cable guide screws 84 are mounted and a rear section 102 where the conventional bicycle cable locking bolt 46 locks the steering cable 40 to the pivoting rear wheel mounting welded assembly 88 to facilitate the rotational action. Two wheel mounting members 104 and 106 are canted rearward with the rear wheel 20 held by the means of wheel bolt 108 and nut 110. A central pivot bolt 112 goes through the rear wheel mounting welded assembly 88 and through a thrust bearing 114 then into the rear wheel base plate 76.

It should be noted and understood by someone skilled in the art of making skateboards, that the rear single wheel truck could be replaced by a dual wheel truck, similar to the dual wheel truck described, having the capability of connecting to a cable and being pivotally mounted on the bottom of the skateboard board portion. In this regard, the skateboard could actually be a four-wheeled skateboard and still have the improved cable actuated turning control, enhanced quickness, and a significantly reduced turning radius.

It should be noted and understood by someone skilled in the art of making skateboards, that the front dual wheel truck could be replaced by a rear single wheel truck, similar to the single wheel truck described, having the capability of connecting to a cable and being pivotally mounted on the bottom of the skateboard board portion. In this regard, the skateboard could actually be a two-wheeled skateboard and still have the improved cable actuated turning control, enhanced quickness, and a significantly reduced turning radius.

Additionally, the Three-wheeled Skateboard 10 shown in the drawings and described in detail herein, could be ridden backwards such that the front dual wheel truck is located in the rear and the rear single wheel truck is located in the front.

The Three-wheeled Skateboard 10 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a Three-wheeled Skateboard 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A three-wheeled skateboard comprising:

(a) a board portion having a top surface and a bottom surface;

(b) a rear single wheel truck pivotally mounted to said board portion bottom surface wherein said rear single wheel truck pivotally mounted to said board portion bottom surface further includes a wheel base plate and a wheel mounting assembly pivotally attached to said wheel base plate;

(c) a front dual wheel truck pivotally mounted to said board portion bottom surface; and (d) one or more cables connected to and running from said front two-wheel truck to said rear single wheel truck;

whereby when a rider standing on the top surface of said board portion applies the rider's weight to the left or right side of said board portion, said front dual wheel truck turns to the side where the rider's weight is applied, and said rear single wheel truck pivots in the opposite direction through the action of said cable thereby improving the turning control of the skateboard, the quickness of the action of the skateboard and reducing the turning radius of the skateboard.

2. The three-wheeled skateboard according to claim 1, wherein said wheel base plate and wheel mounting assembly pivotally attached to said wheel base plate further include cable attachment capability and are attached to said cable.

3. The three-wheeled skateboard according to claim 1, wherein said front dual wheel truck pivotally mounted to said board portion bottom surface further includes an adapter plate and a steering plate pivotally attached to said dual wheel truck.

4. The three-wheeled skateboard according to claim 3, wherein said adapter plate and a steering plate pivotally attached to said dual wheel truck further include cable attachment capability and are attached to said cable.

5. The three-wheeled skateboard according to claim 1, wherein said rear single wheel truck pivotally mounted to said board portion bottom surface is removed and replaced with a dual wheel truck pivotally mounted to said board portion bottom surface, making the three-wheeled skateboard into a four-wheeled skateboard having improved the turning control, increased quickness of the action and a reduced turning radius of the skateboard.

6. The three-wheeled skateboard according to claim 1, wherein said front dual wheel truck pivotally mounted to said board portion bottom surface is removed and replaced with a single wheel truck pivotally mounted to said board portion bottom surface, making the three-wheeled skateboard into a two-wheeled skateboard having improved the turning control, increased quickness of the action and a reduced turning radius of the skateboard.

7. The three-wheeled skateboard according to claim 1, wherein said rear single wheel truck includes a single wheel mounted in rear of the front centerline of said rear single wheel truck for the purpose of increasing the quickness of the action of the rear wheel movement.

8. The three-wheeled skateboard according to claim 1, wherein said one or more cables further includes a cable sheath and a cable sheath Teflon liner.

9. The three-wheeled skateboard according to claim 1, wherein said one or more cables is located in a hollow channel located in said board portion.

10. A method for making a three-wheeled skateboard comprising the steps of:

(a) providing a board portion having a top surface and a bottom surface;

(b) providing a rear single wheel truck pivotally mounted to said board portion bottom surface wherein said rear single wheel truck pivotally mounted to said board portion bottom surface further includes a wheel base plate and a wheel mounting assembly attached to said wheel base plate;

(c) providing a front dual wheel truck pivotally mounted to said board portion bottom surface; and (d) providing one or more cables connected to and running from said front two-wheel truck to said rear single wheel truck;

whereby when a rider standing on the top surface of said board portion applies the rider's weight to the left or right side of said hoard portion, said front dual wheel truck turns to the side where the rider's weight is applied, and said rear single wheel truck pivots in the opposite direction through the action of said cable thereby improving the turning control of the skateboard, the quickness of the action of the skateboard and reducing the turning radius of the skateboard.

11. The method for making a three-wheeled skateboard according to claim 10, wherein said wheel base plate and wheel mourning assembly pivotally attached to said wheel base plate further include cable attachment capability and are attached to said cable.

12. The method for making a three-wheeled skateboard according to claim 10, wherein said front dual wheel truck pivotally mounted to said board portion bottom surface further includes an adapter plate and a steering plate pivotally attached to said dual wheel truck.

13. The method for making a three-wheeled skateboard according to claim 12, wherein said adapter plate and a steering, plate pivotally attached to said dual wheel truck further include cable attachment capability and are attached to said cable.

14. The method for making a three-wheeled skateboard according to claim 10, wherein said rear single wheel truck pivotally mounted to said board portion bottom surface is removed and replaced with a dual wheel truck pivotally mounted to said board portion bottom surface, making the three-wheeled skateboard into a four-wheeled skateboard having improved the turning control, increased quickness of the action and a reduced turning radius of the skateboard.

15. The method for making a three-wheeled skateboard according to claim 10, wherein said front dual wheel truck pivotally mourned to said board portion bottom surface is removed and replaced with a single wheel truck pivotally mounted to said board portion bottom surface, making the three-wheeled skateboard into a two-wheeled skateboard having improved the turning control, increased quickness of the action and a reduced turning radius of the skateboard.

16. The method for making a three-wheeled skateboard according to claim 10, wherein said rear single wheel truck includes a single wheel mounted in rear of the front centerline of said rear single wheel truck for the purpose of increasing the quickness of the action of the rear wheel movement.

17. The method for making a three-wheeled skateboard according to claim 10, wherein said one or more cables further includes a cable sheath and a cable sheath Teflon liner.

18. The method for making a three-wheeled skateboard according to claim 10, wherein said one or more cables is located in a hollow channel located in said board portion.

* * * * *